United States Patent [19]

Wilson

[11] 4,404,564

[45] Sep. 13, 1983

[54] ATTACHMENT FOR ANTENNAS TO IMPROVE RECEPTION AND TRANSMISSION

[76] Inventor: George P. Wilson, North Andover, Mass.

[21] Appl. No.: 346,766

[22] Filed: Feb. 8, 1982

Related U.S. Application Data

[63] Continuation-in-part of Ser. No. 110,644, Jan. 9, 1980, Pat. No. 4,321,603.

[51] Int. Cl.[3] ..... H01Q 1/32; H01Q 9/36

[52] U.S. Cl. ..... 343/750

[58] Field of Search ..... 343/749, 750, 895

[56] References Cited

U.S. PATENT DOCUMENTS 4,038,661 7/1977 Nolte ..... 343/750

4,080,604 3/1978 Wosniewski ..... 343/750

*Primary Examiner*—Eli Lieberman

*Attorney, Agent, or Firm*—Edward A. Gordon

[57] ABSTRACT

A devise adapted to be attached to an omni-directional antenna having an elongated conductive element adapted to be mounted vertically. The devise comprises a non-conductive core member having means for attaching said core member to the elongated conductive element and having an inner metallic sleeve disposed about the nonconductive core member and electrically isolated from the elongated conductive element and an outer open-wound coil attached to the non-conductive core member in spaced relationship from the inner sleeve and electrically isolated therefrom. The outer coil has its coil turns wound at an angle to the inner. In another embodiment of the invention, the inner sleeve comprises a metallic wire mesh sleeve.

7 Claims, 7 Drawing Figures

FIG.6
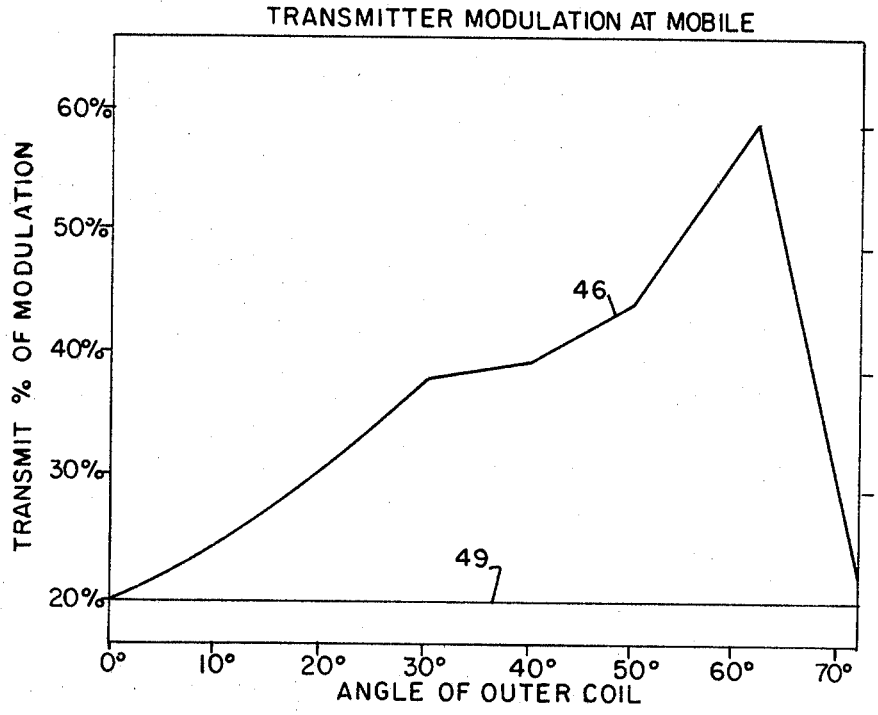
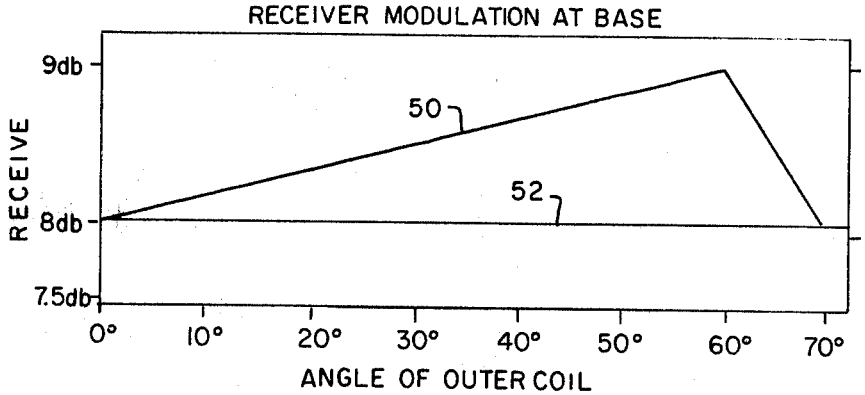
FIG.7

ATTACHMENT FOR ANTENNAS TO IMPROVE RECEPTION AND TRANSMISSION

CONTINUATION-IN-PART

This application is a continuation-in-part of my copending application Ser. No. 110,644, filed Jan. 9, 1980, now U.S. Pat. No. 4,321,603.

BACKGROUND OF THE INVENTION

The present invention relates to antennas and more particularly to a devise to be attached to an omni-directional antenna having an elongated conductive element to improve the transmission and reception.

While the discussion of the device of the present invention will be in relation to antennas for citizens band radio antennas for simplicity, it is to be understood that it has application to antennas employed for other frequencies.

Vertical antennas are frequently employed on both land and water mobile vehicles for both transmitting and receiving communications. Most mobile antennas for citizens band radios, for example, are omni-directional and are formed of an elongated conductive element adapted to be mounted vertically. Such antennas are generally constructed of a metallic tube or rod having an electrical length equal to a quarter-wave in length of the desired communication frequency. These range in physical length from about nine feet for 27 MHz to about six inches for 470 MHz. The antenna length may be physically lengthened or shortened to accommodate waves of various frequencies. When this is not practical the antenna is loaded by adding inductance to increase its effective length or by adding capacitance to decrease its effective length. Another type of verticle antenna in use having an elongated conductive element is a helical antenna which consists of an insulating post such as fiberglass and an antenna conductor, such as copper wire, which is wound helically about the post to define the helical antenna.

For motor vehicles, the antennas are generally physically smaller than that required for maximum efficiency and are provided with a loading coil in an effort to compensate for the shortening of the antenna. These antennas have a range less that than desired.

It is therefore the desire of this invention to provide a devise which will improve the range of transmission and reception of an omni-directional antenna of the type having an elongated conductive element adapted to be mounted generally vertically.

It is also desirable to provide such a device for improving the transmission and reception of such types of antennas which can be easily mounted on the existing antenna without modification and is particularly suitable for mobile antennas.

It is also desirable to provide such a devise for attachment to such type of antennas which will reduce the static received at the designated frequency.

SUMMARY OF THE INVENTION

The device of the present invention comprises a non-conductive core member having means for attaching the core member about the elongated conductive element of an antenna, an inner metallic sleeve disposed about the non-conductive core member and electrically isolated from said elongated conductive element and an outer open-wound coil attached to said core member in spaced relationship to said inner sleeve and electrically isolated therefrom, said outer coil having coil turns wound at an angle to said inner sleeve.

In attaching the device of the present invention to an antenna, it is preferable to position it at a point on the antenna where the standing wave ratio (SWR) is less than 1.5 and most approximates a 1.1 to 1 SWR. Where the antenna is provided with a loading coil, the device of the present invention is preferably positioned below it where SWR is acheived as described above, or above a base loaded coil.

BRIEF DESCRIPTION OF THE DRAWINGS

For a fuller understanding of the nature and desired objects of the invention, reference should be had to the following detailed description taken in connection with the accompanying drawings, wherein like reference characters refer to corresponding parts through the several views and wherein:

FIGS. 6 and 7 show respectively the transmission and reception modulation pattern with and without the invention as angle of the outer coil turns are varied.

DETAILED DESCRIPTION OF THE INVENTION

Figure 1:
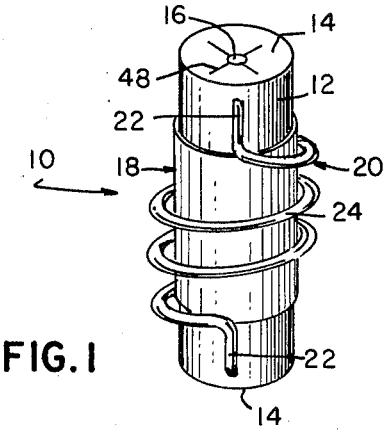
FIG. 1 is a perspective view of the device of the present invention.
Figure 2:
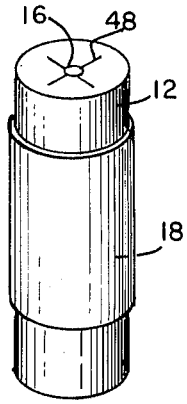
FIG. 2 is a perspective view illustrating the non-conductive core member and the inner metallic sleeve thereon of the device of FIG. 1.
Figure 3:
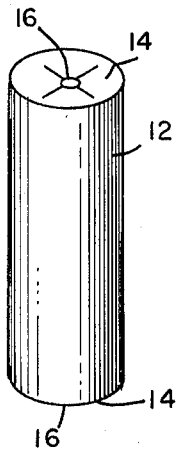
FIG. 3 is a perspective view illustrating the center non-conductive core member of the device of FIG. 1.

Referring now to FIGS. 1, 2, and 3 of the drawing, there is illustrated the device of the present invention generally designated by the numeral 10. The device 10 comprises a hollow cylindrical or tubular center core member 12 having the ends 14 covered. The ends 14 of the center core member 12 are provided with openings 16 to receive the elongated conductive element of the antenna upon which it is to be mounted. The openings 16 serve to hold the walls of the cylindrical core member 12 in spaced relationship from the conductive element of the antenna. The ends 14 of the core member are preferably sufficiently flexible to receive various sizes of the elongated conductive element of antennas as will be described hereinafter. The center core member 12 is formed of a non-conductive material such as plastic. While other materials are suitable, the main requirement is that the material be non-conductive and sturdy. Around the mid-portion of the center core member 12 there is disposed a cylindrical metallic inner sleeve 18. While a thin copper foil is suitable for forming the sleeve 18, other magnetic metals and alloys can be used. The non-conductive center core 12 electrically isolates the sleeve 18 from the elongated conductive element of the antenna upon which the device 10 is mounted. By the term electrically isolated as used in the specification and claims it is meant that there is no physical contact. The metallic sleeve 18 may be held in position on the core member 12 by any suitable adhesive applied to the inner surface of a sleeve 18 for adhesive contact to core member 12.

Disposed upon the center core 12 and in spaced relationship about the metallic sleeve 18 is an outer open-wound coil 20. The ends 22 of the outer coil 20 are attached to the center core 12 at points beyond the inner sleeve 18 so as to be electrically isolated from the inner sleeve 18. The outer coil 20 can be formed of any non-ferrous metal or alloy. One suitable metal is aluminum and its alloys.

The turns 24 of the outer coil 20 are wound at an angle to the horizontal plane surface of the inner sleeve 18 and is preferably between 55°-65° to maximize operation as discussed hereinafter. The ends 22 of outer coil 20 can be attached to core member 12 by any suitable adhesive (not shown) well known to those skilled in the art.

In a preferred embodiment the sleeve 18 and center core member 12 and attaching ends of outer coil 20 are coated with a thin heat shrinkable protective plastic coating (not shown). Suitably such protective coating may be of the type described with respect to envelope 44 of FIG. 4.

Figure 4:
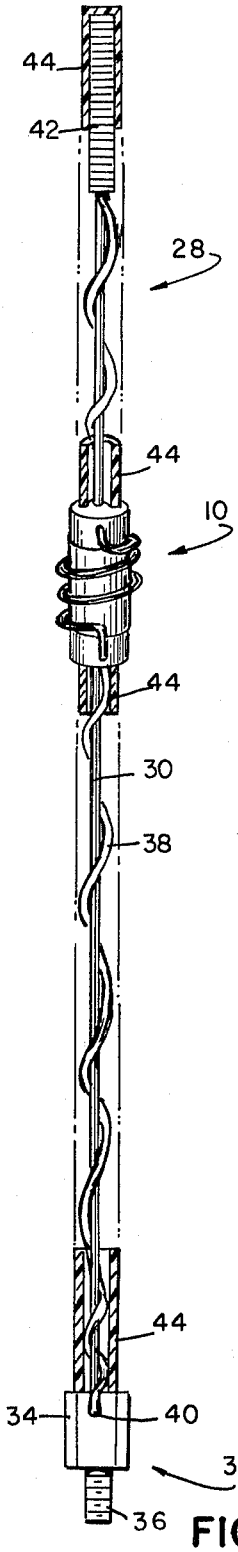
FIG. 4 is an elevational view, partilaly in section, illustrating the device of FIG. 1 attached to a top-loaded helically-wound vertically antenna for citizen band operation.

Referring now to FIG. 4, there is illustrated the device of the present invention as shown in FIG. 1 attached to a top-loaded helically-wound vertical antenna generally designed with the numeral 28. The antenna is designed for 11 meter citizen band operation within the 25–30 MHz band having a designed midrange resonant frequency of approximately 27 MHz.

The vertical antenna includes an insulating rod 30 which is attached to a mounting member 32 at its lower end. Mounting number 32 is suitably brass and includes a mounting ferrule 34 to which the rod 30 is epoxied for attachment and having a threaded reduced end 36 for connecting to a matching, female threaded support member (not shown) mounted on a vehicle or the like. Suitably such a support member would include a spring support (not shown) well known in the art. A coaxial cable, e.g. a standard 52 ohm coaxial cable is connected in the usual manner to the antenna support member and through such support member to the mounting fixture 32. The coaxial cable connects in the usual manner to radio equipment and is utilized alternatively to provide RF energy to the antenna and receive RF energy from the antenna.

The rod 30 is perferably made of a tubular or solid section of fiber glass rod approximately four feet long and supports an electrically conductive element 38 which is preferably 16–20 gauge copper wire having an insulating coating thereon. Suitably the wire 38 is electrically connected to mounting fixture 32 at its lower end 40. At the upper end, of rod 30, the electrically conductive element 38 is tightly wound to provide an upper loading coil 42. The purpose of this loading coil is primarily to reduce the overall height of the antenna. For example, in the 27 Megahertz citizens band, a guarterwave antenna would be approximately 108" long, while the present overall antenna, from tip-to-tip including the mounting fixture 32, is approximately 48" long. The electrically conductive element 38 between the upper loading coil 42 and the mounting fixture 32 is gently wound to provide a larger spaced pitch and an overall helical configuration.

The entire antenna is preferably covered and protected by a weather-tight protective insulating envelope 44. Preferably the envelope 44 is constructed of a tubular plastic material that has been heat shrunk to provide a water-tight insulating envelope over the antenna and the electrical elements.

In attaching the device 10 of the present invention to the antenna it is slipped over the top of antenna 28 by means of end holes 16 and is preferably positioned below the upper loading coil 42. When the holes 16 are not sufficiently wide to clear the upper loading coil 42 for example, the ends 14 are sufficiently slit along the lines 48 from the holes 16 to accomodate passage while providing a tight fit. The device 10 is then adjusted to "tune" the antenna to obtain the optimum transmission and reception. As is well known, adjustments are made on the basis of a standing wave ratio (SWR) meter measurements. The device 10 is moved upward or downward to a position to obtain optimum transmission and reception. This position is preferably at an SWR reading of 1.5:1 to 1.1:1.

Although not to be taken in a limiting sense an embodiment of the device of the present invention will now be described as employed on the top loaded helically wound vertical antenna of the type described with respect to FIG. 4.

In this embodiment, the center core member 12 is a thin hollow cylinder formed of a rigid polycarbonate plastic approximately 3 inches long and approximately $\frac{3}{4}$ inch in outside diameter. Around the mid-portion of the core member, it disposed the innter metallic surface or shield 18, formed of a sheet of copper foil having open dimensions of approximately 0.003 inches thick by 1.25 inches long and 2.37 inches in width or circumference. The copper shield is wrapped around the core 12 so that the longitudinal ends meet or just overlap to form a continuous cylinder physically attached to the center core but not to the electrically conductive element 38 of the antenna 28. The outer coil is formed of non-ferrous 8 guage wire of approximately 10.5 inches in length and is open-wound wound about the inner shield 18. The ends of coil 20 are physically attached to the center core 12 at points between the ends of the inner shield 18 and the ends 14 of the core member 12 but are not physically attached to the inner shield 18 or the electrically conductive element of the antenna. The outer coil is wound at an angle of approximately 60° to the horizontal plane of the inner shield 18. The outer coil turns as wound with such spaced turns form a gentle overall helical configuration. The weight of the completed device 10 is approximately 1.5 ounces.

Referring now to FIG. 6 there is shown a graph 46 of the percent transmission modulation (ordinate of the graph) from a mobile station utilizing the device of FIG. 1 as the angle of the outer coil turn 24 is varied from 0° (horizontal) to 70° with respect to horizontal (the abscissa of the graph). The graph 49 shows the transmission modulation without the device of the present invention.

Referring to FIG. 7 there is shown a graph 50 showing the reception at a base station of the transmission shown in FIG. 6. The ordinate of the graph represents decibels while the abscissa is the same as the graph of FIG. 6. The graph 52 shows the reception without the device of the present invention. With reference to FIGS. 6 and 7 the antenna attachment of the present invention was as described above with respect to FIG. 4 and was attached to a mobile station CB transceiver comprising a stock model with a stock trunk mounted base loaded $\frac{5}{8}$ wave omni-directional antenna. The base station was a stock model transceiver with a stock $\frac{5}{8}$ wave antenna. The distance between stations was approximately 4 miles with varying terrain. The graphs 46 and 50 are representative of the various channels employed for transmission.

It has been found that when the device of the present invention is attached to the elongated conductive element of an omni-directional antenna, it improves voice transmissions and reception, reduces interference and greatly increases the effective range of transmission and reception.

While the invention has been described in connection with certain preferred embodiments, it should be understood that the invention is by no means limited thereto. For example, the center core may be formed of any non-conductive insulating material such as styrofoam, the main requirement being that it hold the inner sleeve and outer coil in spaced relationship from each other and from the electrically conductive element of the antenna about which it is disposed.

Figure 5:
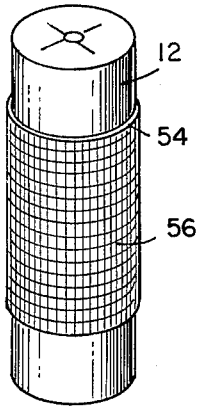
FIG. 5 is a modified embodiment of the inner sleeve of FIG. 2, illustrating the inner sleeve as a metallic wire mesh sleeve.

Additionally, reference now being made to FIG. 5, the inner sleeve may comprise a metallic sleeve 54 with perforations 56. Once suitable sleeve would be a copper screen with preferably a fine to medium mesh size to maximize performance.

Additionally, it has been found that a length of approximately 1 ¼ inches for the inner sleeve is suitable where the length of the antenna 18 is substantially an electrical quarterwave of the antenna's operating frequency. In accordance with this relationship where the antenna is a half-wave in length of the operating frequency, the length of the device 10 may be increased to proportionally increase the length of the inner sleeve to 2 ½ inches or approximately twice the length of that employed for the quarter wave antenna.

While the theoretical considerations for the operation of the device of the present invention are not completely understood the device appears to strengthen horizontally directed lobes of radiation which extend the operating range of the transmitter or receiver to which the antenna is attached. It is believed that the strengthened field is the result of electrostatic and electromagnetic coupling which cooperate to desirably alter and/or strengthen the radiation pattern.

While the invention has been described with respect to preferred embodiments it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in a limiting sense.

What is claimed is:

1. A device adapted to be attached to an omni-directional antenna having an elongated conductive element comprising:

an inner metallic sleeve disposed in spaced axial relationship about said elongated conductive element, and an outer open-wound coil having coil turns disposed in spaced relationship about, said inner metallic sleeve, said inner metallic sleeve and said outer open-wound coil being electrically isolated from each other and from said elongated conductive element, said outer open-wound coil turns being wound at an angle to said inner metallic sleeve.

2. The device of claim 1 wherein:

said open wound coil turns are wound at an angle of between 55° to 65° to said inner metallic sleeve.

3. The device of claim 1 wherein:

said metallic sleeve comprises a perforated metallic sleeve.

4. The device of claim 1 or 3 wherein:

said inner metallic sleeve is formed of copper wire screen.

5. A device adapted to be attached to an omni-directional antenna having an elongated conductive element comprising:

a non-conductive core member disposed about said elongated conductive element, an inner metallic sleeve disposed about said non-conductive core member and electrically isolated from said elongated conductive element, and an outer open-wound coil attached to said core member in spaced relationship about said inner metallic sleeve and electrically isolated therefrom, said outer coil having coil turns wound at an angle to said inner metallic sleeve.

6. A device adpated to be attached on an omni-directional antenna having an elongated conductive element comprising:

a non-conductive generally cylindrical core member having means for attaching said core member in spaced relationship about said elongated conductive element, an inner perforated metallic sleeve disposed about a portion said non-conductive core member and electrically isolated from said elongated conductive element, and an outer open-wound coil wound about and in spaced relationship to said inner metallic sleeve and electrically isolated therefrom, said outer coil having coil ends mounted on the core member portions extending beyond said inner perforated metallic sleeve, being wound at an angle to said inner perforated metallic screen.

7. A device adapted to be attached to an omni-directional antenna having a substantially vertical conductive element and having an effective length less than the antenna's operating frequency comprising:

a non-conductive cylindrical core member having means for attaching said core member in spaced relationship about said vertical conductive element, an inner metallic sleeve disposed about said core member and electrically isolated from said vertical conductive element, and an outer open-wound coil having coil turns wound in spaced relationship to each other and to said inner metallic sleeve and electrically isolated from said inner metallic sleeve, said inner metallic sleeve having a unit of length proportional to said antenna's operating wave length, said outer coil having a coil turns wound at an angle to the longitudinal axis of said metallic sleeve.

* * * * *